United States Patent [19]

McGeary

[11] Patent Number: 4,613,199

[45] Date of Patent: Sep. 23, 1986

[54] DIRECT-CRIMP COAXIAL CABLE CONNECTOR

[75] Inventor: Peter G. McGeary, Hobe Sound, Fla.

[73] Assignee: Solitron Devices, Inc., Riviera Beach, Fla.

[21] Appl. No.: 641,992

[22] Filed: Aug. 20, 1984

[51] Int. Cl.[4] ..... H01R 17/18

[52] U.S. Cl. ..... 339/177 R; 339/276 R; 339/89 C

[58] Field of Search ..... 339/177, 276 R, 268, 339/89 C

[56] References Cited

U.S. PATENT DOCUMENTS

| | | | |
|---|---|---|---|
| 2,604,508 | 7/1952 | Bergan | 174/84 |
| 2,941,028 | 6/1960 | Edlen et al. | 174/75 |
| 3,091,748 | 5/1963 | Takes et al. | 339/177 R |
| 3,103,548 | 9/1963 | Concelman | 339/177 R |
| 3,292,136 | 12/1966 | Somerset | 339/177 E |
| 3,320,575 | 5/1967 | Brown et al. | 339/177 R |
| 3,325,752 | 6/1967 | Barker | 333/34 |
| 3,336,566 | 8/1967 | Barker | 339/143 R |
| 3,344,227 | 9/1967 | Gilmartin et al. | 174/88 |
| 3,390,374 | 6/1968 | Forney | 339/177 R |
| 3,406,373 | 10/1968 | Forney, Jr. | 339/97 |
| 3,428,739 | 2/1969 | Jackson | 339/177 R |
| 3,480,722 | 11/1969 | Van Horssen et al. | 174/87 |
| 3,488,625 | 1/1970 | Collin | 339/177 R |
| 3,496,496 | 2/1970 | Fiesel et al. | 333/33 |
| 3,613,050 | 10/1971 | Andrews | 339/177 R |
| 3,982,060 | 9/1976 | Avery et al. | 339/177 R |
| 4,046,052 | 9/1977 | Nordstrom | 85/61 |
| 4,046,451 | 9/1977 | Juds et al. | 339/177 R |
| 4,059,330 | 11/1977 | Shirey | 339/177 R |
| 4,135,776 | 1/1979 | Ailawadhi et al. | 339/177 R |
| 4,138,188 | 2/1979 | Shannon | 339/177 E |
| 4,156,554 | 5/1979 | Aujla | 339/177 R |
| 4,159,667 | 7/1979 | Nordstrom | 85/61 |
| 4,165,911 | 8/1979 | Laudig | 339/89 C |
| 4,239,313 | 12/1980 | Parr | 339/89 C |
| 4,255,011 | 3/1981 | Davis et al. | 339/177 R |
| 4,280,749 | 7/1981 | Hemmer | 339/177 R |
| 4,305,638 | 12/1981 | Hutter | 339/177 R |
| 4,357,067 | 11/1982 | Labbe et al. | 339/177 R |
| 4,400,050 | 8/1983 | Hayward | 339/177 R |
| 4,408,822 | 11/1983 | Nikitas | 339/177 R |
| 4,444,453 | 4/1984 | Kirby et al. | 339/177 R |
| 4,452,503 | 6/1984 | Forney, Jr. | 339/177 R |
| 4,456,323 | 6/1984 | Pitcher et al. | 339/177 R |
| 4,469,390 | 9/1984 | LeVine et al. | 339/177 R |

*Primary Examiner*—Gil Weidenfeld
*Assistant Examiner*—David L. Pirlot
*Attorney, Agent, or Firm*—Staas & Halsey

[57] ABSTRACT

A direct-crimp coaxial cable connector having a captive inner pin contact includes a tubular main body which extends from the front end which serves as an outer ring contact to the rear end where the tubular main body is crimped over the cable braid of a coaxial cable. A crimp ring is provided inside the rear end of the tubular main body and secures the cable braid of the coaxial cable against a ferrule which is inserted between the cable braid and the cable dielectric prior to crimping. The ferrule captivates an insulator ring and an inner pin contact which are rear-loaded into the tubular main body of the connector prior to crimping. A cylindrical contact insulator is secured inside the front end of the tubular main body, separates the inner pin contact from the front end of the tubular main body and secures the inner pin contact in combination with the insulator ring and ferrule. Threads are provided on the inside surface of the ferrule to hold the ferrule in position during crimping, to help provide positive contact to the tubular main body and to captivate the insulator ring and inner pin contact.

9 Claims, 3 Drawing Figures

DIRECT-CRIMP COAXIAL CABLE CONNECTOR

BACKGROUND OF THE INVENTION

The present invention relates to a coaxial cable connector, and more particularly, to a coaxial cable connector having a captive contact and being attached to the coxial cable using a direct crimp.

As is well known in the art, coaxial cables have an inner conductor surrounded by a dielectric which separates the inner conductor from a cylindrical conductor, typically a woven cable braid. The cable braid is in turn encased by an insulative cable jacket. Connectors are attached to coaxial cables to connect the cables to jacks or other connectors.

What is desired by many manufacturers using coaxial cables is a connector which has minimal machined parts and is therefore economical, yet at the same time provides a secure, captive pin contact. Connectors for coaxial cables in the prior art usually have one of these features but not all of them. For example, one of the simplest connectors is disclosed in U.S. Pat. No. 4,059,330. This patent teaches a connector consisting of four (4) elements—an inner pin contact or metallic prong attached to the inner conductor of the coaxial cable, a dielectric tubular plug which holds the pin contact and separates the braided outer conductor of the coaxial cable therefrom, an electrically conductive body and a threaded collar. The electrically conductive body is slipped over the jacket of the coaxial cable prior to assembly and the threaded collar is used to attach the coaxial cable to a jack or another connector and in doing so helps hold the components in place.

A more elaborate and secure connector is disclosed in U.S. Pat. No. 4,456,323. This patent teaches a variation of the "wedgelock" connector which has a captive inner pin contact and a good seal with the jacket of the coaxial cable, but requires a considerable amount of machining even in the simplified version disclosed in the '323 patent. As is known in the art, an inner pin contact can be rear-loaded into the body of a "wedgelock" connector prior to sealing by a wedge-nut which seals the rear of the connector when the wedge-nut is screwed into internal threads at the rear of the connector body.

A similar seal can be made when a clamping nut is used, as in U.S. Pat. No. 4,444,453. However, when a clamping nut is used, it is not possible to easily provide a captive inner pin contact since the body of the connector typically has a hole bored in it with a diameter just larger than the diameter of the dielectric of the coaxial cable. A clamping nut is then screwed onto the rear of the connector via external threads to seal the braided outer conductor and the jacket against the body of the connector.

A less expensive connector is a direct-crimp connector which uses a crimp tool to compress a crimp ring in place of the clamping nut used by the connector disclosed in the '453 patent. One prior art direct-crimp connector which includes a captive contact uses a Teflon insulator to hold a snap-in pin contact. However, when this type of connector is used with small coaxial cables, the inner conductor has a tendency to buckle when inserted into the pin contact.

Another type of connector that uses a crimp ring is a crimp-clamp connector in which the body is separated into two (2) parts so that the inner pin contact can be rear-loaded into the front end of the connector body. A clamp portion of the body is then attached to the connector body and a crimp ring is used to attach the coaxial cable to the clamp portion of the body. The result is a connector with a secure, captive inner pin contact, but which is relatively bulky due to the extra clamp portion. U.S. Pat. No. 4,280,749 (hereinafter the '749 patent) discloses a connector similar to the crimp-clamp connector. In the '749 patent the connector body passes over the cable jacket and locks into a resilient bushing around the cable jacket.

Direct-crimp coaxial cable connectors are disclosed in U.S. Pat. Nos. 4,400,050 and 4,239,313 (hereinafter the '050 and '313 patents) which are attached to coaxial cables by crimping the main body instead of a crimp ring. In the '050 patent, an inner tubular element is inserted between the cable dielectric and the cable braid of a coaxial cable and extends forward to provide an outer ring contact. The connector in the '313 patent is initially a one-piece unit including a main body which extends from an arrow-like part at the rear into a swivel nut portion at the front of the connector. The main body of the connector serves to retain the swivel nut and act as an outer ring contact. When the main body is crimped, the crimped portion breaks off the remainder of the connector, in other words, the '313 connector essentially includes a crimp ring which is merely temporarily attached to the main body.

SUMMARY OF THE INVENTION

Accordingly, an object of this invention is to provide a coaxial cable connector with few machined parts and which includes a captive inner pin connector.

Another object of this invention is to provide a coaxial cable connector in which a rear portion of the connector body is crimped over the coaxial cable braid and jacket.

Yet another object of the present invention is provide a direct crimp coaxial cable connector which includes a self-tapping ferrule against which the coaxial cable braid is crimped by a crimp ring and the connector body.

A further object of the present invention is to provide a coaxial cable connector into which the inner pin connector can be rear-loaded and captivated when the connector is crimped.

Yet a further object of the present invention is to provide a coaxial cable connector with a captive pin contact which can be used with small coaxial cables without buckling of the inner conductor of the cable when the connector is attached.

A still further object of the present invention is to provide a coaxial cable connector having an integral connector body which forms the outer terminal edge at one end and is crimped around the outside of the coaxial cable at the other end.

In accordance with the present invention, the foregoing and other objects are achieved by a coaxial cable connector including a tubular main body, insulating means for providing electrical insulation between the tubular main body and the inner conductor of a coaxial cable and a ferrule locatable inside the tubular main body and insertable around the cable dielectric of the coaxial cable and under the cable braid of the coaxial cable, the tubular main body being crimpable around the cable braid and the ferrule. A preferred embodiment of the present invention includes a tubular main body of a malleable and electrically conductive material, preferably having a front end which provides an outer ring contact, and the insulating means for providing electrical insulation between the tubular main body of the connector and the inner conductor of the coaxial cable to which the connector is attached. The connector is attached to the cable by removing a portion of the cable jacket and then inserting a ferrule of an electrically conductive material between the cable braid and the cable dielectric. The rear end of the tubular main body of the connector is slipped over the ferrule and the end of the coaxial cable, and crimped by a hex crimp tool to hold the cable braid between the rear end of the tubular main body and the ferrule. The insulating means preferably includes a cylindrical contact insulator inside the front end of the tubular main body of the connector. An inner pin contact is inserted, from the rear into a pin bore in the cylindrical contact insulator and is followed by an insulator ring prior to slipping the tubular main body over the end of the coaxial cable. Preferably, the front end of the ferrule has self-tapping internal threads which self-tap onto the dielectric to hold the ferrule in place and a crimp ring is included inside the rear end of the tubular main body of the connector.

BRIEF DESCRIPTION OF THE DRAWINGS

The accompanying drawings, wherein like numerals refer to like parts throughout and which are incorporated in and constitute a part of the specification, illustrate an embodiment of the invention and, together with the description, serve to explain the principles of the invention.

DESCRIPTION OF THE PREFERRED EMBODIMENT

Figure 1:
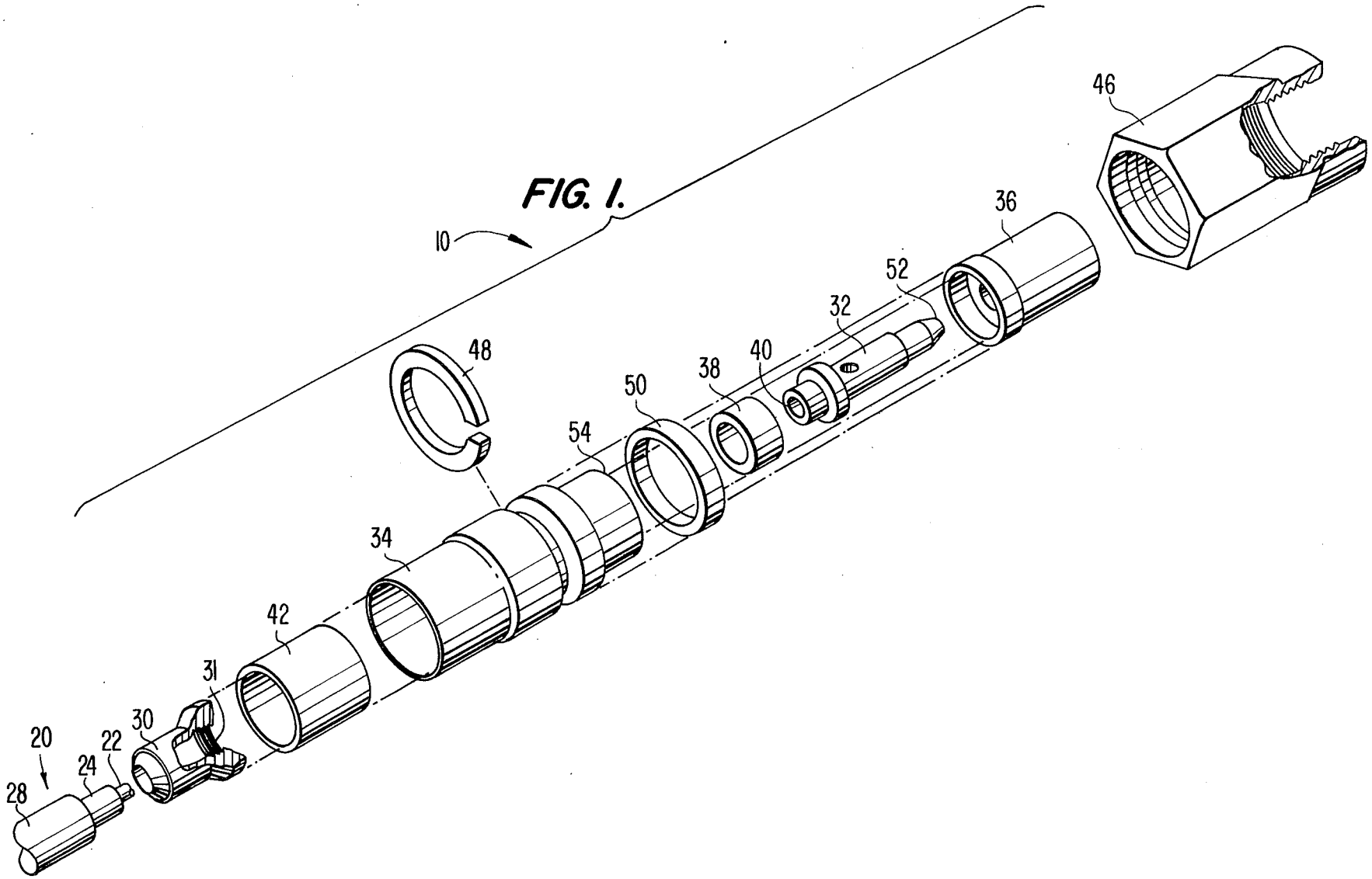
FIG. 1 is an exploded view of a coaxial cable connector according to the present invention.
Figure 2:
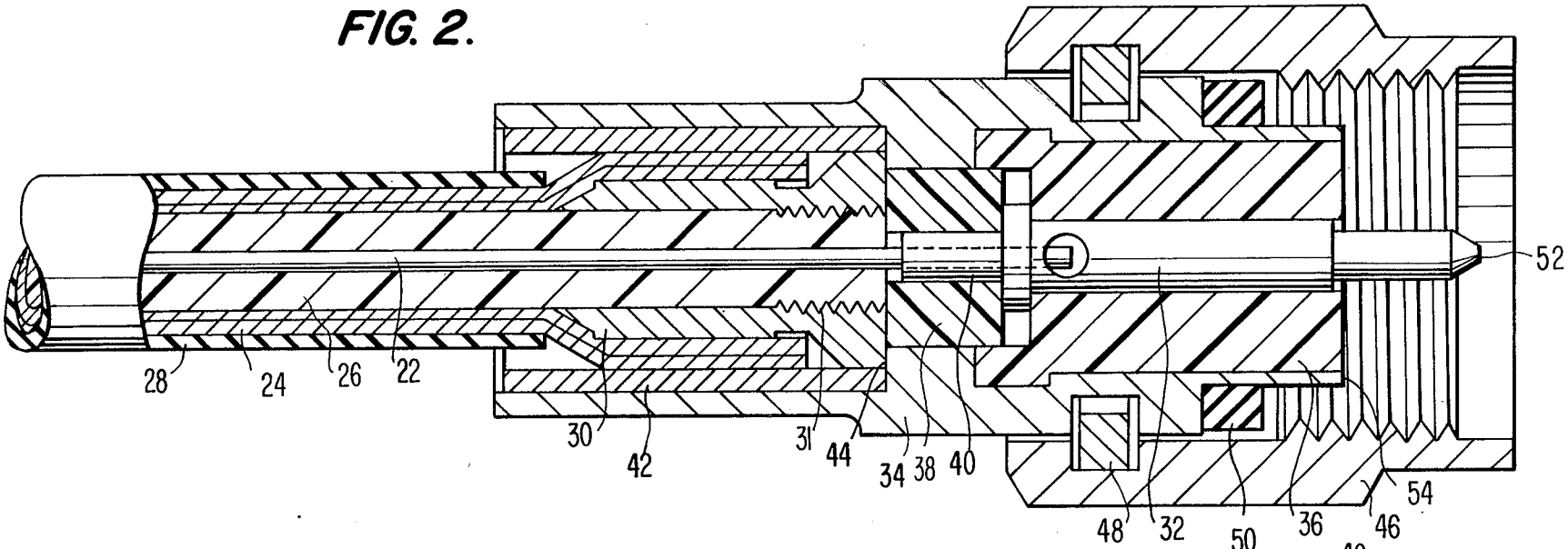
FIG. 2 is an axial sectional view of a coaxial cable connector according to the present invention, prior to crimping by a hex crimp tool.
Figure 3:
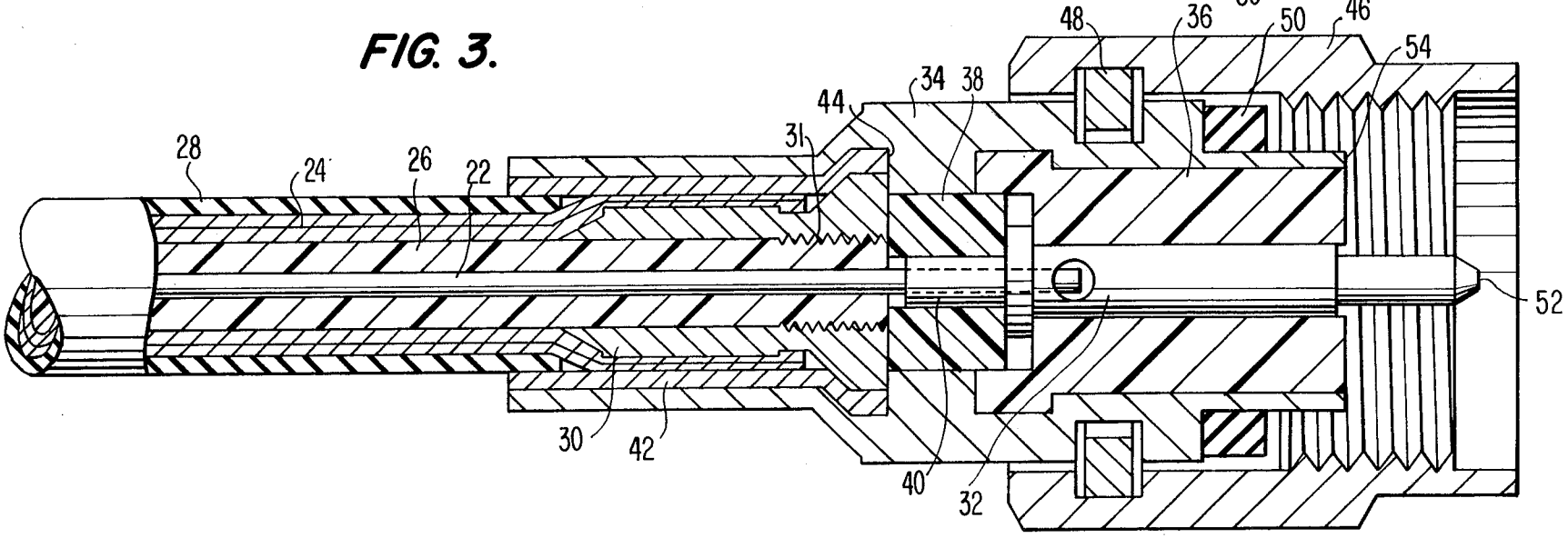
FIG. 3, is an axial sectional view of the coaxial cable connector of FIG. 2, following crimping by the hex crimp tool.

In the preferred embodiment of a coaxial cable connector 10 according to the present invention, illustrated in FIGS. 1–3, the connector 10 is attached to a coaxial cable 20 having an inner conductor 22 separated from a woven outer conductive cable braid 24 by a cable dielectric 26. The cable braid 24 is enclosed by a cable jacket 28 formed of an insulating material. The cable connector 10 of the present invention is attached to the coaxial cable 20 by removing a portion of the cable jacket 28 and screwing a ferrule 30, rear end first, onto the cable dielectric 26 under the cable braid 24 using self-tapping threads 31 at the front end of the interior wall of the ferrule 30. The ferrule 30 is made of an electrically conductive material. An inner pin contact 32 is then loaded into the rear of a tubular main body 34 of a malleable and electrically conductive material. A cylindrical contact insulator 36 is locatable inside the tubular main body 34 and insulates the inner pin contact 32 from the main body 34 when the inner pin contact 32 is inserted therein. An insulator ring 38 is then placed over the rear end of the inner pin contact 32. The cable 20 and ferrule 30 are inserted into the main body 34 so that the tip of the cable inner conductor 22 enters a hole 40 bored in the rear of the inner pin contact 32 and the ferrule 30 abuts against the main body 34 and the insulator ring 38. The rear of the main body 34 and a crimp ring 42 located inside the rear end of the main body 34 are compressed by a hex crimp tool (not shown), securing the cable braid 24 against the exterior surface of the ferrule 30 and forcing the ferrule 30 against a shoulder 44 on the tubular main body 34, thus captivating the insulator ring 38 and the inner pin contact 32.

The thus attached cable connector 10 can then be used to connect the coaxial cable 20 to a jack or another connector (not shown) using a mating shell 46, held by a retaining ring 48 which allows the mating shell 46 to freely turn. A gasket 50 makes a secure seal with the jack or connector to which the coaxial cable 20 is to be attached and the tip 52 of the inner pin contact 32 and the outer ring contact 54 of the main body 34 provide the electrical connections to the jack or other connector.

As can be seen from the foregoing, the structure of the present invention permits assembly of the connector components in a manner which achieves certain advantages over the prior art. In particular, extending the main body 34 of the connector 10 rearwardly over the cable jacket 28, instead of under the cable braid 24, permits the inner pin contact 32 to be rear-loaded into the cylindrical contact insulator 36. None of the direct-crimp and non-crimp connectors in the prior art have this capability. Even the '050 and '313 patents which teach extending the main body of the connector over the cable jacket do not have the capability to rear-load and captivate an inner pin contact. Only the connector designs which have an additional clamping element, such as the connector in the '749 patent, the crimp-clamp connectors and the wedgelock connectors, have the capability to rear-load an inner pin contact. However, all of these designs are unnecessarily bulky and expensive to produce.

On the other hand, a connector 10 according to the present invention uses essentially the conventional crimping method of a crimp ring 42 while including the feature of extending the main body 34 over the exterior of the crimp ring 42 rather than inserting the main body 34 between the cable dielectric 26 and the cable braid 24, as in the prior art. The threads 31 on the ferrule 30 provide additional security for the attachment of the connector 10 to the coaxial cable 20, but are not absolutely necessary to practice the invention so long as the main body 34 presses the ferrule 30 against the shoulder 44 and the insulator ring 38, thus captivating the inner pin contact 32. The threads 31 enable the ferrule 30 to be properly positioned on the cable dielectric 26 throughout the assembly process and help to maintain pressure by the ferrule 30 against the insulator ring 38.

The many features and advantages of the present invention are apparent in the detailed specification, and thus it is intended by the appended claims to cover all such features and advantages of the connector which fall within the true spirit and scope of the invention. Further, since numerous modifications and changes will readily occur to those skilled in the art, it is not desired to limit the invention to the exact construction and operation illustrated and described, accordingly, all suitable modifications and equivalents may be resorted to, falling within the scope and spirit of the invention.

What is claimed is:

1. A coaxial cable connector having an inner conductor separated from a cable braid of a cable dielectric having a dielectric diameter, the cable braid being encased by a cable jacket having a jacket diameter, said connector comprising:

a tubular main body of a malleable and electrically conductive material, having a first inner diameter larger than the packet diameter of the cable jacket;

insulating means, locatable inside said tubular main body for providing electrical insulation between said tubular main body and the inner conductor of the coaxial cable; and a ferrule, locatable inside said tubular main body, of an electrically conductive material, said ferrule having an axial bore substantially larger than the dielectric diameter of the cable dielectric and an exterior surface with a front end having a maximum outer diameter, a center section with an outer diameter smaller than the maximum outer diameter and a rear end at which the outer diameter of the center section tapers rearwardly toward the axial bore, said connector being attachable to the coaxial cable by inserting said ferrule between the cable braid and the cable dielectric, inserting said insulating means into said tubular main body and sliding said tubular main body over said ferrule and the coaxial cable, then crimping said tubular main body to exert axially directed pressure to hold the cable braid against the front end of said ferrule.

2. A coaxial cable connector as recited in claim 1, wherein said ferrule has threads at the front end of said ferrule, said threads being capable of self-tapping attachment to the dielectric of the coaxial cable.

3. A coaxial cable connector as recited in claim 2, wherein said tubular main body has a rear end having the first inner diameter, and wherein said coaxial cable connector further comprises a crimp ring locatable inside the rear end of said tubular main body, said crimp ring pressing the cable braid against said ferrule when said tubular main body is crimped.

4. A coaxial cable connector as recited in claim 1, wherein said tubular main body has a rear end having the first inner diameter, and wherein said coaxial cable connector further comprises a crimp ring located inside the rear end of said tubular main body, said crimp ring pressing the cable braid against said ferrule when said tubular main body is crimped.

5. A coaxial cable connector as recited in claim 4, wherein said crimp ring has a continuous tubular shape with substantially smooth inner and outer surfaces.

6. A coaxial cable connector as recited in claim 1, wherein said insulating means comprises:

a cylindrical contact insulator securable in said tubular main body and having a pin bore; and an insulator ring insertable in said main body, and wherein said coaxial cable connector further comprises an inner pin contact operatively connectable to the inner conductor of the coaxial cable and insertable in said insulator ring and the pin bore of said cylindrical contact insulator.

7. A coaxial cable connector as recited in claim 6, wherein said inner pin contact has a maximum pin diameter smaller than the second inner diameter of said tubular main body and larger than the pin bore of said cylindrical contact insulator, a front pin diameter smaller than the pin bore of said cylindrical contact insulator and a rear pin diameter, and wherein said insulator ring has an inner ring diameter smaller than the maximum pin diameter and larger than the rear pin diameter and a rear surface which abuts against the front end of said ferrule when said coaxial cable connector is assembled.

8. A coaxial cable connector for a coaxial cable having an inner conductor separated from a cable braid by a cable dielectric, the cable braid being encased by a cable jacket, said connector comprising:

a tubular main body;

insulating means, locatable inside said tubular main body, for providing insulation between said tubular main body and the inner conductor of the coaxial cable; and a ferrule, locatable inside said tubular main body and insertable around the cable dielectric and under the cable braid, having a front end with self-tapping internal threads for attaching said ferrule to the cable dielectric, said tubular main body being crimpable around the cable braid and said ferrule.

9. A coaxial cable connector as recited in claim 8, wherein said insulating means comprises:

a cylindrical contact insulator securable in said tubular main body and having a pin bore; and an insulator ring insertable in said main body, and wherein said coaxial cable connector further comprises an inner pin contact operatively connectable to the inner conductor of the coaxial cable and insertable in said insulator ring and the pin bore of said cylindrical contact insulator.

* * * * *

UNITED STATES PATENT AND TRADEMARK OFFICE

CERTIFICATE OF CORRECTION

PATENT NO. : 4,613,199

DATED : September 23, 1986

INVENTOR(S) : McGeary

It is certified that error appears in the above-identified patent and that said Letters Patent is hereby corrected as shown below:

Column 5, line 3, "packet" should be --jacket--.

Signed and Sealed this

Tenth Day of February, 1987

*Attest:*

DONALD J. QUIGG

*Attesting Officer*

*Commissioner of Patents and Trademarks*